US006016085A

United States Patent [19]

Mazzochette

[11] Patent Number: 6,016,085

[45] Date of Patent: Jan. 18, 2000

[54] FLAT CABLE LOAD

[75] Inventor: Joseph B. Mazzochette, Cherry Hill, N.J.

[73] Assignee: EMC Technology LLC, Cherry Hill, N.J.

[21] Appl. No.: 09/161,766

[22] Filed: Sep. 28, 1998

[51] Int. Cl.[7] ..... H01P 1/26

[52] U.S. Cl. ..... 333/22 R; 338/216

[58] Field of Search ..... 333/22 R, 81 A; 338/216

[56] References Cited

U.S. PATENT DOCUMENTS

| | | | |
|---|---|---|---|
| 3,621,479 | 11/1971 | Peterson | 333/22 R |
| 3,678,417 | 7/1972 | Ragan et al. | 333/22 R |
| 3,790,904 | 2/1974 | Lesjk et al. | 333/22 R |
| 5,598,131 | 1/1997 | Mazzochette | 333/22 R |
| 5,841,340 | 11/1998 | Passaro, Jr. et al. | 333/22 R X |

FOREIGN PATENT DOCUMENTS

| | | | |
|---|---|---|---|
| 4-90601 | 3/1992 | Japan | 333/22 R |
| 1086484 | 4/1984 | U.S.S.R. | 333/22 R |

*Primary Examiner*—Paul Gensler
*Attorney, Agent, or Firm*—Donald S. Cohen

[57] ABSTRACT

An RF termination load includes a base of an electrically and thermally conductive material having opposed surfaces. A recess is in one of the surfaces of the base and a groove in the one surface extends from the recess to an edge of the base. A resistor is seated in the recess in the base. The resistor includes a substrate of an electrically insulating material having opposed surfaces and a resistance film on one of the surface of the substrate. A first contact of a resistance film is on the one surface of the substrate at one end of the resistor and a second contact of an electrically conductive material is on the one surface of the substrate at the other end of the resistor. The second contact extends over an edge of the substrate and over the other surface of the substrate. The resistor is mounted in the recess with the second contact being seated on and contacting the base. An RF cable has an end in the groove in the base. The cable has an inner conductor which is electrically connected to the first contact of the resistor and an outer shielding conductor which is electrically connected to the base. A cover extends over the base and the resistor and is secured to the base. The cover and base having aligned mounting holes therethrough.

11 Claims, 2 Drawing Sheets

FLAT CABLE LOAD

FIELD OF THE INVENTION

The present invention relates to a flat cable load RF termination, and, more particularly to a flat cable load which is relatively small but has good thermal performance. and Which is relatively inexpensive to manufacture.

BACKGROUND

A flat cable load is a high frequency termination used in systems that cannot tolerate the high temperatures generated by the load in the vicinity of other sensitive components. The load is used to absorb all of the electromagnetic energy by converting it to heat. The performance of the load is determined by the amount of energy that it reflects and absorbs as a function of frequency and temperature. The load is connected to the system using a coaxial, stripline twisted pair or other transmission line. The load case is connected to a heat sink suitably large to keep the load at or below its maximum operating temperature. It is desirable that the load be relatively small but still have good thermal performance. Also, it is desirable that the load be relatively inexpensive to manufacture.

SUMMARY OF THE INVENTION

An RF termination load includes a substantially flat base of an electrically and thermally conductive material. The base has opposed flat surfaces, a first recess in one of the flat surface and a groove in the one surface extending from the recess to an edge of the base. A resistor is mounted in the first recess in the base. The resistor includes a substrate of an electrically insulating material having opposed surfaces. A resistance film is on one of the surfaces of the substrate. A first conductive termination is on the one surface of the substrate at one end of the resistor and a second conductive termination is on the one surface of the substrate at another end of the resistor. The second termination extends from the one surface over an edge of the substrate and across the other surface of the substrate. The resistor is mounted in the recess in the base with the second termination seated on and contacting the base. An RF cable has an inner conductor and a ground conductor insulated from the inner conductor. The cable is seated in the recess in the base with the inner conductor electrically connected to the one termination of the resistor and the ground conductor electrically connected to the base.

DETAILED DESCRIPTION

Figure 1:
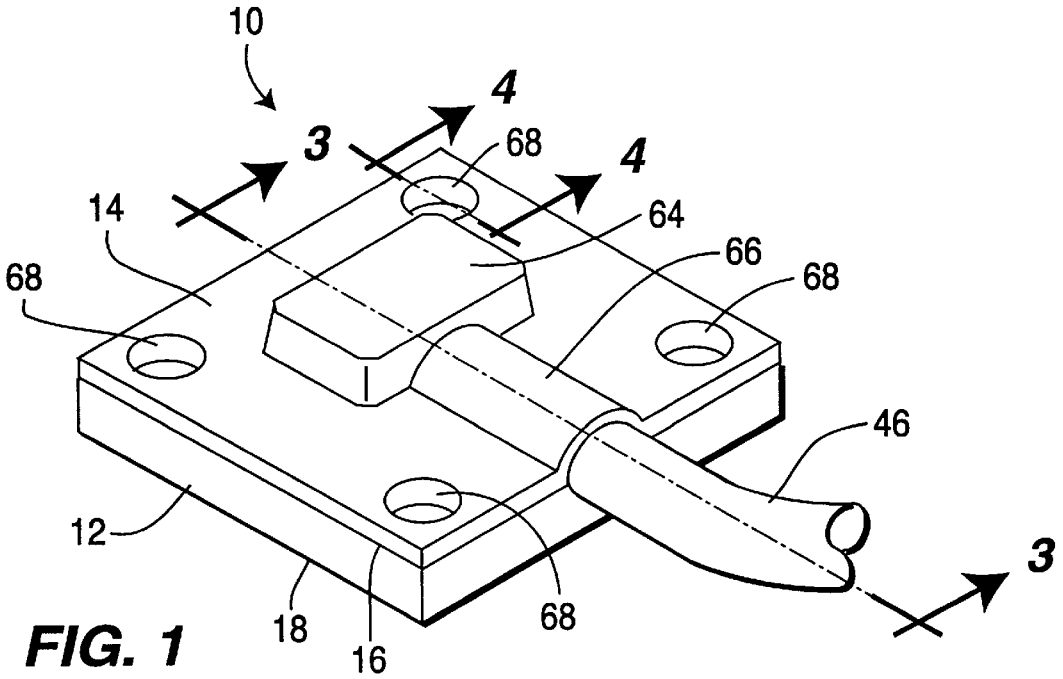
FIG. 1 is a perspective view of the flat cable load of the present invention.
Figure 2:
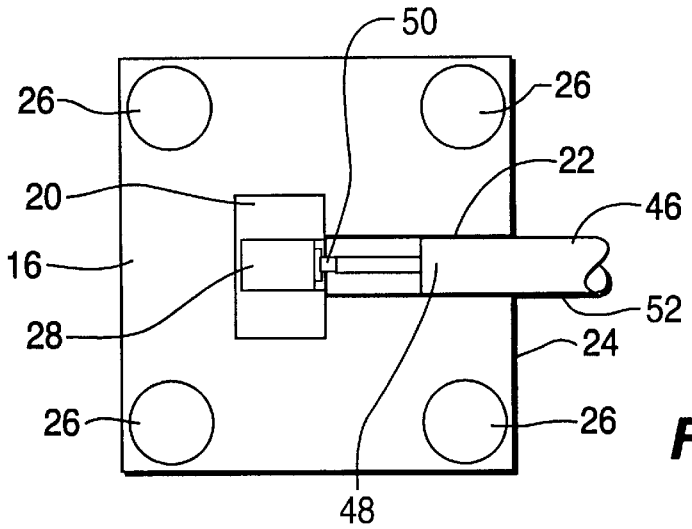
FIG. 2 is a top view of the cable load with the cover removed.
Figure 3:
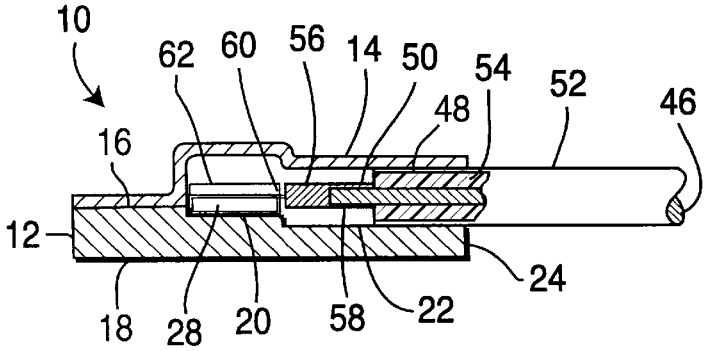
FIG. 3 is a sectional view taken along line 3—3 of FIG. 1.

Referring initially to FIG. 1, a flat cable load 10 of the present invention comprises a base 12 of an electrically and thermally conductive material, such as a metal, and a metal cover 14. The base 12 has a pair of substantially flat opposed top and bottom surfaces 16 and 18. As shown in FIGS. 2 and 3, the base 12 has a recess 20 in the center of its top surface 16 and a groove 22 extends along the top surface 16 from the recess to an edge 24 of the base. A separate hole 26 extends through the base 12 from its top surface 16 to its bottom surface 18 at each comer of the base 12.

Figure 5:
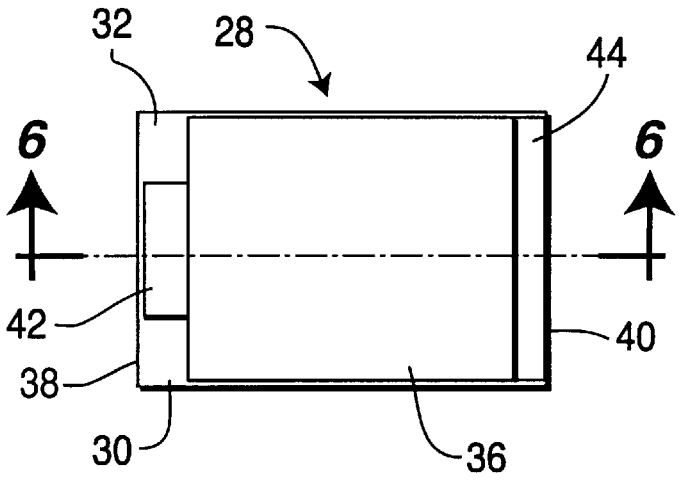
FIG. 5 is a top view of the resistor used in the cable load of the present invention.
Figure 6:
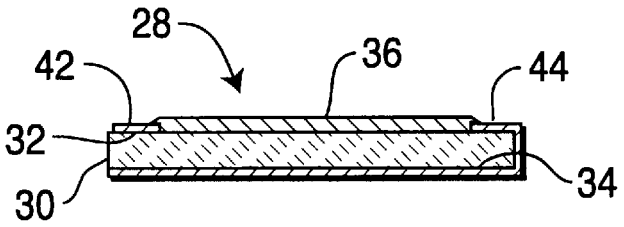
FIG. 6 is a sectional view take along line 6—6 of FIG. 5.
Figure 7:
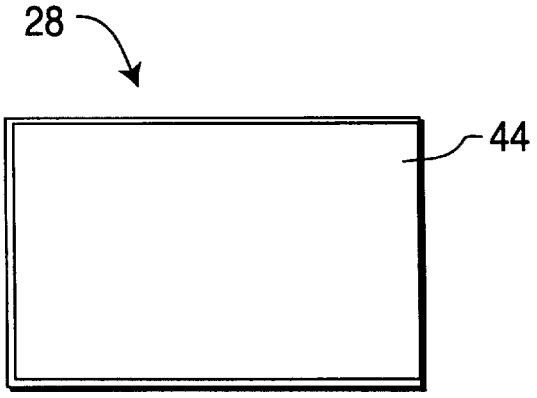
FIG. 7 is a bottom view of the resistor.

As shown in FIGS. 2 and 3, a resistor 28 is in the recess 20 in the top surface 16 of the base 12. As shown in FIGS. 5, 6 and 7, resistor 28 comprises a substantially rectangular substrate 30 of an electrically insulating material, such as a ceramic or plastic. The substrate 30 has substantially flat top and bottom surfaces 32 and 34. A film 36 of a resistance material is on the top surface 32 of the substrate 30 and extends between but is spaced from opposed edges 38 and 40 of the substrate. The resistance film 36 may be of any suitable resistance material. A first contact film 42 of an electrically conductive material, such as a metal, is on the top surface 32 of the substrate 30 and extends between the resistance film 36 and the edge 38 of the substrate 30. A second contact film 44 of an electrically conductive material, such as a metal, is on the top surface 32 of the substrate 30. The second contact film 44 extends from the resistance film 36 to and around the edge 40 of the substrate 30 and across the bottom surface 34 of the substrate 30. Each of the first and second contact films 42 and 44 engage the resistance film 36 so as to be electrically connected thereto. Thus, the resistance film 36 is electrically connected between the first and second contact films 42 and 44. The resistor 28 is seated in the recess 20 in the base 12 with the second contact film 44 being seated on and engaging the surface of the recess 20 and with the first contact film 42 being adjacent the end of the groove 22. The resistor 28 is secured in the recess 20 by a suitable electrically conductive cement, such as a solder.

As shown in FIGS. 1, 2 and 3, a coaxial cable 46 has an end 48 seated in the groove 22 in the base 12. The cable 46 has a inner conductor 50, an end portion of which is exposed, and an outer shielding conductor 52 which is spaced from and insulated from the inner conductor 50 by a suitable insulating material 54. A portion of the outer shielding conductor 52 is seated on and contacts the surface of the groove 22 so as to be electrically connected to the base. If desired, the cable 46 maybe secured to the base 12 by a suitable electrically conductive cement, such as a solder, between the outer shielding conductor 52 and the base 12. A metal strain relief pin 56 is on the end of the inner conductor 50. The strain relief pin 56 has a sleeve 58 at one end which slidably fits over the end of the inner conductor 50 and a terminal pin 60 at its other end which extends over and contact the first contact film 42 on the resistor 28. A cover plate 62 of an electrically insulating material, such as a ceramic or plastic, extends over the resistance film 36 and the terminal pin 60. The cover plate 62 is secured to the resistor 28 by a suitable cement, such as an epoxy. The cover plate 62 serves to protect the resistance film 36 and to secure the terminal pin 60 to the first contact film 42. However, if desired, the cover plate 62 may be eliminated and the terminal pin 60 secured directly to the first contact film 42 by a suitable electrically conductive cement, such as a solder. Also, if strain relief is not essential, the strain relief pin 56 may be eliminated and the inner conductor 50 of the cable 46 could be connected directly to the first contact film 42.

Figure 4:
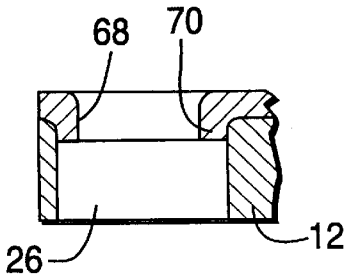
FIG. 4 is a sectional view taken along line 4—4 of FIG. 1.

The cover 14 extends over the top surface 26 of the base 12 and has recess portions 64 and 66 which extend over the resistor 36 and the cable 46 respectively. The cover 14 has a separate hole 68 in each corner thereof each of which is aligned with a separate hole 26 in the base 12. As shown in FIG. 4, at each of the holes 68 is a cylindrical projection 70 which extends downwardly into and fits tightly into the respective hole 26 in the base 12. This secures the cover 14 tightly to the base 12.

In the operation of the flat cable load 10, the cable 46 is connected to a source of electromagnetic energy, and the load 10 is mounted on a suitable heat sink with the base 12 being seated on the heat sink. The load 10 can be secured to the heat sink by passing bolts or screws through the aligned holes 26 and 68 in the base 12 and cover 14 and into the heat sink. The energy passing through the resistor 36 generates heat which is absorbed by the load 10 and is transferred to the heat sink through the base 12. Although the flat cable load 10 is shown with a coaxial cable 46, any other type of transmission line, such as a twisted pair, stripline, microstrip or coplanar line, may be used. The flat cable load 10 of the present invention has the advantages that it is formed of a minimum number of parts, such as the base 12 and cover 14, which are of low cost stamped construction, and which are easily assembled. Also, the flat cable load 10 has low thermal resistance and consistent electrical performance. Thus, there is provided by the present invention a flat cable load which is relatively small in size, has good thermal conduction properties so as to have good electrical characteristics and can be made and assembly relatively inexpensively.

What is claimed is:

1. An RF. termination load comprising:

a substantially flat base of an electrically and thermally conductive material having first and second surfaces, a recess in said first surface and a groove in the first surface extending from the recess to an edge of the base;

a resistor seated in the recess in the first surface of the base, said resistor comprising a substrate of an electrically insulating material having first and second opposed surfaces, a resistance film on said first surface, a first contact of a conductive material on said first surface at one end of the resistance film and a second contact of a conductive material on said first surface and extending from the other end of the resistance film over an edge of the substrate and along the second surface of the substrate, said resistor being seated in the recess with the portion of the second contact which is on the second surface of the substrate being seated on and contacting the base; and an RF cable having an inner conductor and an outer shielding conductor spaced and insulated from the inner conductor, the cable having an end which is seated in the groove in the first surface of the base with the inner conductor being electrically connected to the first contact of the resistor and the outer shielding conductor being electrically connected to the base.

2. The RF termination load in accordance with claim 1 further comprising a cover extending over the first surface of the base and over the resistor and the end portion of the cable which is in the groove, means securing the cover to the base, and aligned openings through the cover and base.

3. The RF termination load in accordance with claim 2 in which the means securing the cover to the base comprises projections extending from around the openings in the cover and fitting tightly into the openings in the base.

4. The RF termination load in accordance with claim 1 further comprising a plate of an insulating material extending over the first surface of the resistor substrate and the resistance film and means securing the plate to the substrate.

5. The RF termination load in accordance with claim 4 in which the means securing the plate to the resistor substrate comprises an insulating cement.

6. The RF termination load in accordance with claim 4 in which the inner core of the cable has means extending between the plate and the resistor substrate which is electrically connected to the first contact on the substrate.

7. The RF termination load in accordance with claim 1 further comprising a strain relief pin electrically connecting to the end of the inner conductor of the cable to the first contact on the substrate of the resistor.

8. The RF termination load in accordance with claim 7 in which the strain relief pin has a sleeve slidably fitting on the end of the inner conductor and a termination pin extending over and secured to the first contact on the resistor substrate.

9. The RE termination load in accordance with claim 8 further comprising a plate extending over the first surface of the resistor substrate, the resistor film and the end of the termination pin strain relief element and means securing the plate to the substrate.

10. The RE termination load in accordance with claim 9 further comprising a cover extending over the first surface of the base and over the resistor and the end portion of the cable which is in the groove, means securing the cover to the base, and aligned openings through the cover and base.

11. The RF termination load in accordance with claim 10 in which the means securing the cover to the base comprises projections extending from around the openings in the cover and fitting tightly into the openings in the base.

* * * * *